US012790084B2

(12) United States Patent
Huff

(10) Patent No.: US 12,790,084 B2
(45) Date of Patent: Nov. 10, 2026

(54) OVERMOLDING VALVE AND BOTTLE

(71) Applicant: Technical Response, Inc., Knoxville, TN (US)

(72) Inventor: Leonard Scott Huff, Knoxville, TN (US)

(73) Assignee: Technical Response, Inc., Knoxville, TN (US)

( * ) Notice: Subject to any disclaimer, the term of this patent is extended or adjusted under 35 U.S.C. 154(b) by 122 days.

(21) Appl. No.: 18/804,212

(22) Filed: Aug. 14, 2024

(65) Prior Publication Data

US 2025/0058944 A1 Feb. 20, 2025

(30) Foreign Application Priority Data

Aug. 17, 2023 (CN) ..... 202322228756.9

(51) Int. Cl.
*B65D 47/20* (2006.01)
*A45F 3/18* (2006.01)

(52) U.S. Cl.
CPC ..... *B65D 47/2031* (2013.01); *A45F 3/18* (2013.01); *B65D 47/2018* (2013.01)

(58) Field of Classification Search
CPC ..... B65D 47/2031; B65D 47/2018
See application file for complete search history.

(56) References Cited

U.S. PATENT DOCUMENTS 7,503,469 B2 * 3/2009 Bloom ..... B65D 47/2031 222/212
8,608,034 B2 * 12/2013 Bloom ..... B65D 51/18 222/490
11,111,061 B2 * 9/2021 Nagai ..... B65D 47/2031

* cited by examiner

*Primary Examiner* — Jennifer C Chiang
(74) *Attorney, Agent, or Firm* — Luedeka Neely, P.C.; Mark P. Crockett

(57) ABSTRACT

An overmolding valve and a bottle are provided, relating to the technical field of bottles. The overmolding valve includes a rigid connecting ring used for connecting to a water outlet of a bottle body, and a flexible valve body, where the flexible valve body and the rigid connecting ring are integrally formed and fixedly connected and cover the water outlet, a valve port is disposed in middle of the flexible valve body, and the flexible valve body is squeezed and deformed to open the valve port. This provides an improvement over gaskets and nozzles in the prior art that easily fall off, resulting in the valve falling off and failure during use.

10 Claims, 2 Drawing Sheets

OVERMOLDING VALVE AND BOTTLE

CROSS-REFERENCE TO RELATED APPLICATIONS

This application claims priority to Chinese Patent Application No. 202322228756.9, filed on Aug. 17, 2023, the content of all of which is incorporated herein by reference.

FIELD OF THE DISCLOSURE

The present disclosure relates to the technical field of bottles, in particular to an overmolding valve and a bottle.

BACKGROUND

Bottles are commonly used as containers in daily life, such as common water bottles. In some water bottles (such as sports water bottles), a soft rubber valve is arranged at a bottle cap. The soft rubber is pressed and deformed by squeezing the water bottle body, thus opening the valve, thus water can be squeezed out of the water bottle body. After the water bottle body is released, the water bottle body is restored to an original state without being pressed, and the soft rubber valve is restored to an original state to close the valve, thus preventing the water in the water bottle body from pouring out.

In the prior art, a valve structure usually consists of a hard gasket and a soft nozzle. The nozzle is connected to the bottle cap by the gasket. The gasket and the nozzle are manufactured separately, and then assembled to form a valve body structure. The assembly process also adopts a way that the gasket presses the nozzle tightly, both of which are easy to fall off, resulting in the valve falling off and failure during use.

Therefore, the prior art still needs to be improved and developed.

BRIEF SUMMARY OF THE DISCLOSURE

In view of the defects of the prior art, a purpose of the present disclosure is to provide an overmolding valve and a bottle to solve the problem that the gasket and nozzle in the prior art are easy to fall off, resulting in the valve falling off and failure during use. The technical solutions of the present disclosure are as set forth herein.

In a first aspect, the present disclosure provides an overmolding valve, including a rigid connecting ring used for connecting to a water outlet of a bottle body and a flexible valve body, wherein the flexible valve body and the rigid connecting ring are integrally formed and fixedly connected and cover the water outlet, a valve port is arranged in middle of the flexible valve body, and the flexible valve body is squeezed and deformed to open the valve port.

In some embodiments, the flexible valve body and the rigid connecting ring are molded by double color injection to overmold an integrated valve.

In some embodiments, the flexible valve body includes an external connector embedded inside the rigid connecting ring and an internal valve body arranged inside the external connector, wherein the valve port is arranged on a surface of the internal valve body. A bending portion is located between the external connector and the internal valve body, and connected to the external connector and the internal valve body, a circular groove is formed between the bending portion and the external connector.

In some embodiments, the internal valve body includes a flexible rubber plate that is located at an inner side of the external connector and is connected to the bending portion, the valve port is arranged on a surface of the flexible rubber plate, and the surface of the flexible rubber plate is a curved surface that gradually sinks in a direction from outside to inside.

In some embodiments, the rigid connecting ring includes a connecting ring body, a limit step is arranged on a surface of a water-outlet side of the connecting ring body, and a top cylinder surface is arranged at an outer wall of the flexible valve body, wherein the top cylinder surface is embedded in the connecting ring body and connected to the limit step.

In some embodiments, the rigid connecting ring is connected to the flexible valve body and is arranged with a clamping structure, wherein the rigid connecting ring and the flexible valve body are clamped inside the water outlet of the bottle body by the clamping structure. The clamping structure includes an outer inclined surface arranged at an outer wall of the rigid connecting ring and an inner inclined surface arranged at an edge of the flexible valve body, wherein the outer inclined surface and the inner inclined surface respectively abut against an undercut on an inner wall of the water outlet.

In some embodiments, the valve port is cross-shaped or star-shaped.

In some embodiments, a bump is arranged on a surface of the rigid connecting ring deviating from the water-outlet side, and a plurality of the bumps are arranged and used for cooperating with an external assembly equipment for limiting.

In some embodiments, a hardness of the flexible valve body is Shore A 30-80 degree, and a hardness of the rigid connecting ring is Shore D 50-95 degree.

In a second aspect, the present disclosure further provides a bottle including a bottle body and the overmolding valve, with a water outlet arranged on the bottle body. The overmolding valve is connected to the water outlet. The bottle body includes a body and a bottle cap that is connected to the body, wherein the water outlet is arranged on the bottle cap, the undercut is arranged on an inner wall of the water outlet, and the overmolding valve is clamped on the bottle cap.

Compared with the prior art, the embodiments of the present disclosure at least have following beneficial effects. The present disclosure provides an overmolding valve and a bottle. The rigid connecting ring and the flexible valve body are integrally molded to form an integrated valve structure, thus providing a fixation between the rigid connecting ring and the flexible valve body that is firmer. Meanwhile, the overmolding valve directly forms the integrated structure by injection molding, and has been assembled in the production process, and it is not necessary to assemble the two parts additionally, thus reducing manual or mechanical assembly process of the flexible valve body and the rigid connecting ring, and greatly improving the production efficiency.

BRIEF DESCRIPTION OF THE DRAWINGS

In order to provide a clearer explanation of the embodiments of the present disclosure or the technical solutions in the prior art, a brief introduction to the drawings required for the description of the embodiments or the prior art in the following description is provided. It is evident that the drawings described below are some embodiments of the present disclosure. These drawings and accompanying descriptions are not intended to limit the scope of the present disclosure in any way, but rather to illustrate the concepts of the present disclosure to those skilled in the art by reference to embodiments. For those skilled in the art, additional drawings can be obtained based on these drawings without the exercise of creative labor.

Explanation of reference labels: 10—overmolding valve, 20—bottle cap, 21—water outlet, 22—undercut, 100—rigid connecting ring, 110—connecting ring body, 111—limit step, 120—bump, 200—flexible valve body, 210—external connector, 211—top cylinder surface, 220—bending portion, 221—circular groove, 230—internal valve body, 231—flexible rubber plate, 232—valve port, 300—clamping structure, 310—outer inclined surface, 320—inner inclined surface.

DETAILED DESCRIPTION OF EMBODIMENTS

The present disclosure provides an overmolding valve and a bottle. To make the purposes, the technical schemes, and the effects of the present disclosure clearer and more definite, more details of the present disclosure are further described in combination with the attached drawings and the embodiments of the present disclosure. It should be understood that the specific embodiments described herein are only used to explain the present disclosure, and are not used to limit the present disclosure.

In the prior art, a gasket and a nozzle of a valve structure of a sport water bottle body are manufactured separately, which not only makes them easy to fall off due to squeezing, but also makes them need manual or mechanical assembly after being manufactured separately, which increases the production process, the production efficiency is not high, and the production cost is increased. Therefore, the present disclosure solves the above problems by the following embodiments.

Embodiment 1

Figure 1:
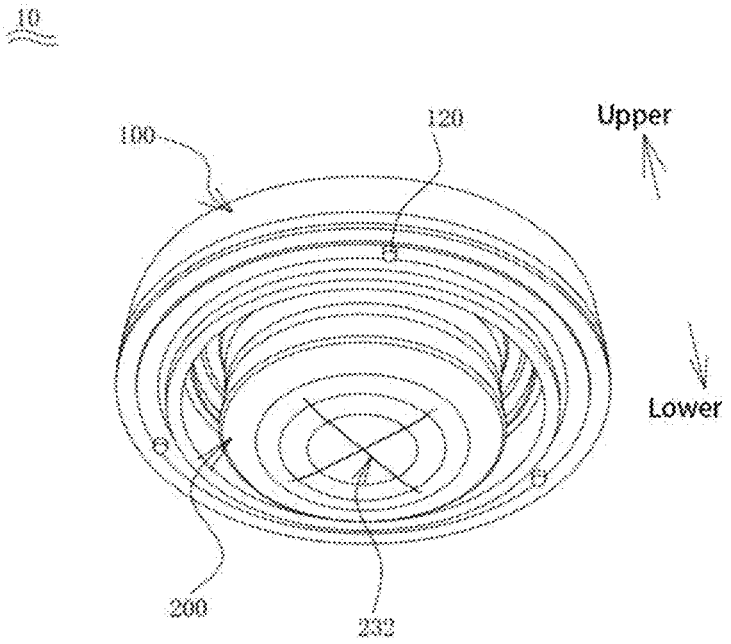
FIG. 1 is a structural schematic diagram of an overmolding valve in the embodiments of the present disclosure.
Figure 3:
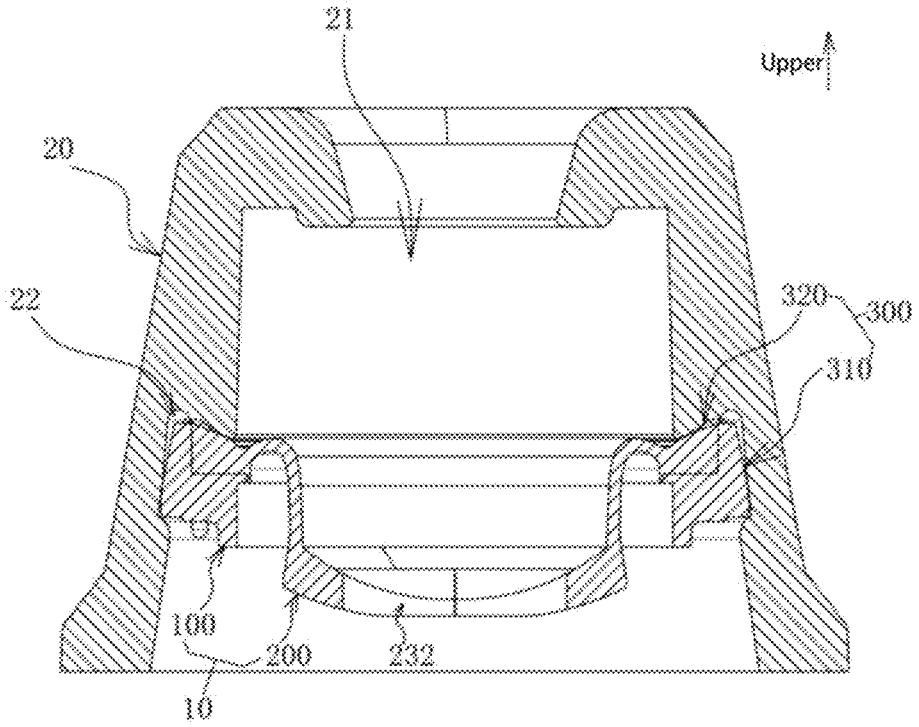
FIG. 3 is a sectional view diagram of the overmolding valve arranged on the bottle cap in the embodiments of the present disclosure.

As shown in FIGS. 1 and 3, the present disclosure provides an overmolding valve 10, used for arranging on the bottle body. The bottle body includes a body with a bottle cap 20 or a separate body. A water outlet 21 is arranged on the bottle body. For instance, the water outlet 21 is arranged on the bottle cap 20. For the convenience of structural description, one side of the water outlet 21 for water outflow is taken as a water outlet side, and the water outlet side is set upward. Taking a central axis of the bottle body as a center point, a direction towards the center point is inward, and a direction away from the center point is outward. As shown in FIG. 3, the overmolding valve 10 mainly includes a rigid connecting ring 100 and a flexible valve body 200. The rigid connecting ring 100 is used for connecting to the water outlet 21 of the bottle body. The material of the rigid connecting ring 100 is hard, and the rigid connecting ring 100 is subjected to the squeezing force (the bottle body is squeezed when water flows out) of the bottle body without deformation, thus the rigid connecting ring 100 can be stably fixed at the water outlet 21. The material of the flexible valve body 200 is soft and easy to deform when the flexible valve body 200 is squeezed. The flexible valve body 200 and the rigid connecting ring 100 are integrally formed by injection molding, thus the two parts are fixedly connected. The rigid connecting ring 100 serves as a bracket to fix the flexible valve body 200 inside the bottle body and make the flexible valve body 200 cover the water outlet 21. A valve port 232 is arranged in the middle of the flexible valve body 200. When the flexible valve body 200 is in an unpressed state, inner walls of the valve port 232 abut against each other, thus the valve port 232 is closed. When the flexible valve body 200 is squeezed by liquid in the bottle body to deform, thus the inner walls of the valve port 232 are squeezed open, and the valve is opened to allow the liquid to flow out. Therefore, by squeezing the bottle body, the liquid in the bottle body is forced, and by being squeezed by the liquid in the bottle body, the flexible valve body 200 is squeezed and deformed to open the valve port 232.

Figure 2:
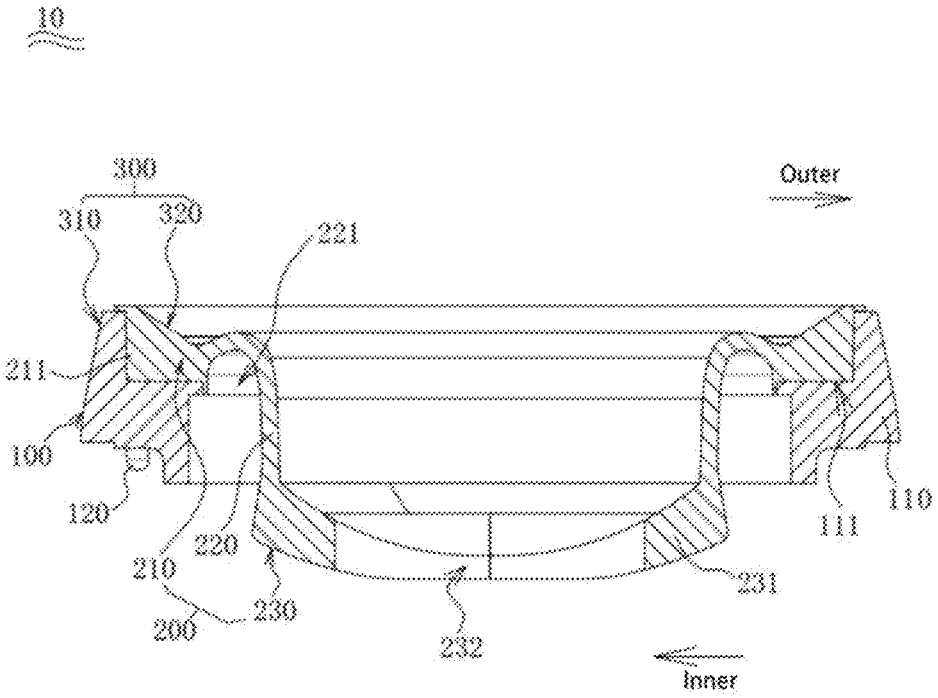
FIG. 2 is a sectional view diagram of the overmolding valve in the embodiments of the present disclosure.

As shown in FIGS. 2 and 3, the usage principle and effects of the present disclosure are as follows: the flexible valve body 200 is stably fixed in the bottle body by the rigid connecting ring 100 and covers the water outlet 21. When in use, the liquid in the bottle is pressed by squeezing the water bottle, thereby squeezing the flexible valve body 200, causing the flexible valve body 200 to be pressed and deformed, thus opening the valve port 232 after deformation, and opening the water outlet 21, thereby squeezing the liquid out of the water bottle. When the water bottle is released, the water bottle returns to an original state without being pressed, and the flexible valve body 200 returns to an original state, thus the valve is contracted and closed, and the water outlet 21 is closed, thereby preventing the liquid in the water bottle from pouring out. The rigid connecting ring 100 and the flexible valve body 200 are integrally molded to form an integrated valve structure, thus a fixation between the rigid connecting ring 100 and the flexible valve body 200 is firmer and is unseparated unless the rigid connecting ring 100 and the flexible valve body 200 are violently damaged, thus preventing the valve of the bottle from falling off and failing during use. Meanwhile, the integrated structure is directly formed by injection molding, and assemblies have been completed in the production process, and it is not necessary to assemble the two parts additionally, thus reducing manual or mechanical assembly process of the flexible valve body 200 and the rigid connecting ring 100, and greatly improving the production efficiency.

As shown in FIGS. 2 and 3, furthermore, in the embodiment, the flexible valve body 200 and the rigid connecting ring 100 are molded by double color injection to overmold an integrated valve. In the embodiment, the rigid connecting ring 100 is made of thermoplastic material, and the flexible valve body 200 is made of thermoplastic elastomer (such as TPE, silica gel, rubber, etc.). The two materials are molded by double color injection, thus overmolding an integrated valve, and the combination firmness of the whole integrated valve is good. Compared with the single silicone structure valve in the prior art, the structural strength is equivalent, and the single silicone structure valve in the prior art needs additional auxiliary assembly (such as a gasket) to be fixed with the bottle body. However, the integrated valve of the embodiment is directly clamped with the bottle body, and has better connection stability.

As shown in FIGS. 2 and 3, furthermore, in the embodiment, a hardness of the flexible valve body 200 is Shore A 30-80 degree. The soft rubber with the hardness facilitates the valve port 232 to be squeezed to open by the liquid in the bottle body. The hardness of the rigid connecting ring 100 is Shore D 50-95 degree. Specifically, the hardness of the hard rubber formed by the rigid connecting ring 100 is Shore D 50-95 degree (6 mm slice and less than 23° C.). When the bottle body is squeezed by the user, the hard rubber with the hardness is not easily deformed, thereby the flexible valve body 200 is firmly connected to the water outlet 21 of the bottle body.

Furthermore, the hardness of the flexible valve body 200 is Shore A more than 80 degree or Shore A less than 30 degree, but is uncomfortable to use. Furthermore, the rigid connecting ring 100 adopts hard rubber with other hardness.

As shown in FIGS. 2 and 3, specifically, in the embodiment, the flexible valve body 200 includes an external connector 210, an internal valve body 230, and a bending portion 220. The rigid connecting ring 100 is matched according to contour of the water outlet 21. For instance, in the embodiment, the rigid connecting ring 100 is circular. The external connector 210 is embedded in an inner ring of the rigid connecting ring 100, the internal valve body 230 is arranged inside the external connector 210, and the valve port 232 is arranged on a surface of the internal valve body 230 and penetrates through the internal valve body 230 along the axial direction. The bending portion 220 is located between and connects to the external connector 210 and the internal valve body 230, and a circular groove 221 is formed between the bending portion 220 and the external connector 210. The flexible valve body 200 is fixedly connected with the rigid connecting ring 100 by the external connector 210, and the external connector 210 and the rigid connecting ring 100 are integrally molded in the injection molding process, thus the connection between the flexible valve body 200 and the rigid connecting ring 100 is more stable. The bending portion 220 encircles an outer edge of the internal valve body 230 to fix the internal valve body 230 and the external connector 210 to form the bending portion 220, the internal valve body 230, and the external connector 210 as a whole structure, and the whole structure covers the water outlet 21. When the internal valve body 230 is squeezed by the liquid in the bottle, the bending portion 220 buffers the stress of the internal valve body 230, thereby a smaller squeezing force is conducted to the external connector 210. Therefore, a joint between the external connector 210 and the rigid connecting ring 100 is less stressed, which ensures connection stability and is not easy to fail in use. Furthermore, the circular groove 221 is formed between the bending portion 220 and the external connector 210. When the internal valve body 230 is squeezed, the circular groove 221 can provide enough deformation space for the deformation of the internal valve body 230 and the bending portion 220, which is convenient for the bending portion 220 to cushion the stress of the internal valve body 230.

Furthermore, the flexible valve body 200 adopts other structures, for example, a cross-sectional shape of the flexible valve body 200 is "n" or a cross-sectional shape of the bending portion 220 is "L" or "S". Some of the structures have poor cushioning performance, while others are complex and not practical.

As shown in FIGS. 2 and 3, furthermore, the internal valve body 230 includes a flexible rubber plate 231, and the flexible rubber plate 231 is located inside the external connector 210 and is connected to the flexible valve body 200. Furthermore, the valve port 232 are arranged on a surface of the flexible rubber plate 231. The surface of the flexible rubber plate 231 is a curved surface. Specifically, both an upper surface and lower surface of the flexible rubber plate 231 are curved surfaces, especially the lower surface. When the curved surface is pressed by the liquid, the position of the valve port 232 is relatively stressed, thereby the valve port 232 can be quickly pushed open.

As shown in FIGS. 2 and 3, furthermore, the curved surface gradually sinks in a direction from the outside to the inside. A vertex of the curved surface is located in a center position and the vertex is the lowest point of the curved surface. When the curved surface is squeezed by a press force of the liquid, the middle of the curved surface is subjected to a larger force. The valve port 232 is located at the center position, thus it is more convenient to push the valve port 232 open.

In another embodiment, the internal valve body 230 is provided with a flexible flange at an edge of the flexible rubber plate 231, thereby increasing the structural stability of the flexible rubber plate 231.

As shown in FIGS. 2 and 3, furthermore, in the embodiment, the rigid connecting ring 100 includes a connecting ring body 110. A limit step 111 is arranged on a surface of a water outlet side of the connecting ring body 110. The limit step 111 is arranged on an upper surface of the connecting ring body 110 and located at one side of an inner ring of the connecting ring body 110. A top cylinder surface 211 is arranged on an outer wall of the flexible valve body 200 and located on an outer edge of the external connector 210. By embedding the top cylinder surface 211 in the connecting ring body 110 and connecting the top cylinder surface 211 to the limit step 111, the flexible valve body 200 and the rigid connecting ring 100 can be fixed. The connecting ring body 110 provides limiting support for the flexible valve body 200 by the limit step 111, and when integrally molded with the flexible valve body 200, the connecting ring body 110 has a larger contact area, thus the connecting area between the connecting ring body 110 and the flexible valve body 200 is larger and the fixed connection is firmer.

Furthermore, the limit step 111 can be arranged on a lower surface of the connecting ring body 110, achieving an effect of firm fixation.

As shown in FIGS. 2 and 3, furthermore, in the embodiment, a clamping structure 300 is arranged. The rigid connecting ring 100 and the flexible valve body 200 are clamped in the water outlet 21 of the bottle body by the clamping structure 300. Specifically, the rigid connecting ring 100 connects to the flexible valve body 200 and the clamping structure 300 is formed at an edge of the water-outlet side. Correspondingly, the inner wall of the water outlet 21 of the bottle body is provided with an undercut 22. The rigid connecting ring 100 is clamped at the undercut 22 in the bottle body by the clamping structure 300, so as to realize the independent assembly with the bottle body. Compared with a structure that all valves in the prior art need additional auxiliary parts to press the single valve to realize the assembly, the clamping structure 300 of the embodiment reduces a plurality of workpieces that need to be reassembled, reduces assembly process, and realizes the stable and fixed connection with the bottle body.

As shown in FIGS. 2 and 3, furthermore, in the embodiment, the clamping structure 300 includes an outer inclined surface 310 arranged at an outer wall of the rigid connecting ring 100, and an inner inclined surface 320 arranged at an edge of the flexible valve body 200. The combination of the outer inclined surface 310 and the inner inclined surface 320 forms a hook shape with a triangular (or trapezoidal) cross-section. During assembly, the outer inclined surface 310 and the inner inclined surface 320, respectively, abut against the undercut 22 on the inner wall of the water outlet 21. A corner angle of the clamping structure 300 with the hook shape is upward, while an opening of the undercut 22 inside the bottle body is downward, thus the overmolding valve 10 is pushed upward into the undercut 22, and the clamping structure 300 is matched with the undercut 22. The undercut 22 of the bottle body limits the rigid connecting ring 100 and the flexible valve body 200 and forms a squeeze cooperation.

Furthermore, the clamping structure 300 can be other inverted structures, for instance, a protrusion is directly arranged on an excircle of the rigid connecting ring 100 to form an inverted structure.

Furthermore, in the embodiment, the valve port 232 is cross-shaped. When the cross-shaped valve port is opened and closed, the flexible rubber plate 231 is divided into four parts to operate, which has good flexibility. Furthermore, the valve port 232 can also be a star-shaped valve port structure consisting of three, four, or more strip-shaped slits distributed along the circumference and connected at one end.

As shown in FIGS. 1 and 3, furthermore, in the embodiment, a bump 120 is arranged on a surface of the rigid connecting ring deviating from the water-outlet side. A plurality of bumps 120 are arranged, for instance, three bumps 120 are uniformly distributed on the lower surface of the rigid connecting ring 100 around the central axis, the plurality of the bumps is used to cooperate with an external assembly equipment for limiting. The bottle body and the overmolding valve 10 are usually automatically assembled by assembly equipment, and in the process of automatic assembly, it is necessary to sort and straighten the overmolding valve 10. Therefore, a plurality of the bumps 120 are arranged to be matched and limited by external assembly equipment, and the overmolding valve 10 is straightened during the assembly process, thereby facilitating the assembly.

Embodiment 2

As shown in FIGS. 2 and 3, the present disclosure provides a bottle, including the bottle body and the overmolding valve 10 of Embodiment 1. The bottle body is arranged with a water outlet 21, the overmolding valve 10 is connected to the water outlet 21.

Furthermore, the bottle body includes a body and a bottle cap 20 (only parts of the structure of the bottle cap are shown in the drawings). The bottle cap 20 is detachably connected to the body, and the water outlet 21 is arranged on the bottle cap 20, thus the overmolding valve 10 is arranged on the bottle cap 20.

Furthermore, the bottle only includes the body, the water outlet 21 is directly arranged on the body, and the overmolding valve 10 is arranged on the body.

Furthermore, an undercut 22 is arranged on the inner wall of the water outlet 21, and the overmolding valve 10 is clamped on the undercut 22. In the embodiment, the undercut 22 is arranged on the inner wall of the bottle cap 20, and the overmolding valve 10 is clamped on the bottle cap 20 by using the undercut 22.

In summary, the present disclosure provides an overmolding valve and a bottle. The rigid connecting ring and the flexible valve body are integrally molded to form an integrated valve structure, thus a fixation between the rigid connecting ring and the flexible valve body is firmer. Meanwhile, the overmolding valve directly forms the integrated structure by injection molding, and has been assembled in the production process, and it is not necessary to assemble the two parts additionally, thus reducing manual or mechanical assembly process of the flexible valve body and the rigid connecting ring, and greatly improving the production efficiency.

It should be understood that the implementations of the present disclosure are not limited to the above embodiments. The present disclosure can be improved or transformed according to the above description for those skilled in the art, and all these improvements and transformations should be included in the protection scope of the attached claims of the present disclosure.

What is claimed is:

1. An overmolding valve comprising:

a rigid connecting ring used for connecting to a water outlet of a bottle body;

a flexible valve body, wherein the flexible valve body and the rigid connecting ring are integrally formed and fixedly connected and cover the water outlet, wherein the flexible valve body comprises:

an external connector embedded inside the rigid connecting ring;

an internal valve body disposed inside the external connector; and a bending portion located between and connected to the external connector and the internal valve body, wherein a circular groove is formed between the bending portion and the external connector; and a valve port disposed in a middle of the flexible valve body and on a surface of the internal valve body, wherein the flexible valve body is squeezed and deformed to open the valve port.

2. The overmolding valve according to claim 1, wherein the flexible valve body and the rigid connecting ring are molded by double color injection to overmold an integrated valve.

3. The overmolding valve according to claim 1, wherein the internal valve body comprises a flexible rubber plate that is located at an inner side of the external connector and is connected to the bending portion, wherein the valve port is disposed on a surface of the flexible rubber plate, and the surface of the flexible rubber plate is a curved surface that gradually sinks in a direction from outside to inside.

4. The overmolding valve according to claim 1, wherein the rigid connecting ring comprises a connecting ring body, and a limit step is disposed on a surface of a water outlet side of the connecting ring body, and a top cylinder surface is disposed at an outer wall of the flexible valve body, wherein the top cylinder surface is embedded in the connecting ring body and connected to the limit step.

5. The overmolding valve according to claim 1, wherein the rigid connecting ring is connected to the flexible valve body and is arranged with a clamping structure, and the rigid connecting ring and the flexible valve body are clamped inside the water outlet of the bottle body by the clamping structure, and the clamping structure comprises an outer inclined surface disposed at an outer wall of the rigid connecting ring and an inner inclined surface disposed at an edge of the flexible valve body, wherein the outer inclined surface and the inner inclined surface respectively abut against an undercut on an inner wall of the water outlet.

6. The overmolding valve according to claim 1, wherein the valve port is cross-shaped or star-shaped.

7. The overmolding valve according to claim 6, wherein a bump is disposed on a surface of the rigid connecting ring deviating from a water outlet side of the rigid connecting ring, and a plurality of the bumps are arranged and used for cooperating with an external assembly equipment for limiting.

8. The overmolding valve according to claim 6, wherein a hardness of the flexible valve body is Shore A 30-80 degree, and a hardness of the rigid connecting ring is Shore D 50-95 degree.

9. An overmolding valve comprising:

a rigid connecting ring used for connecting to a water outlet of a bottle body;

a flexible valve body, wherein the flexible valve body and the rigid connecting ring are integrally formed and fixedly connected and cover the water outlet; and a valve port disposed in a middle of the flexible valve body, wherein the flexible valve body is squeezed and deformed to open the valve port, wherein the rigid connecting ring is connected to the flexible valve body and is disposed with a clamping structure, wherein the rigid connecting ring and the flexible valve body are clamped inside the water outlet of the bottle body by the clamping structure, and wherein the clamping structure comprises:

an outer inclined surface disposed at an outer wall of the rigid connecting ring; and an inner inclined surface disposed at an edge of the flexible valve body, wherein the outer inclined surface and the inner inclined surface respectively abut against an undercut on an inner wall of the water outlet.

10. An overmolding valve comprising:

a rigid connecting ring used for connecting to a water outlet of a bottle body, wherein a bump is disposed on a surface of the rigid connecting ring deviating from a water outlet side of the rigid connecting ring, and a plurality of the bumps are arranged and used for cooperating with an external assembly equipment for limiting;

a flexible valve body, wherein the flexible valve body and the rigid connecting ring are integrally formed and fixedly connected and cover the water outlet; and a valve port disposed in a middle of the flexible valve body, wherein the flexible valve body is squeezed and deformed to open the valve port, wherein the valve port is cross-shaped or star-shaped.

* * * * *